US010086521B2

(12) United States Patent
Huang

(10) Patent No.: US 10,086,521 B2
(45) Date of Patent: Oct. 2, 2018

(54) CUTTER

(71) Applicant: Industro International Co., Ltd., Taichung (TW)

(72) Inventor: Kuo-Chan Huang, Taichung (TW)

(73) Assignee: Industro International Co., Ltd., Taichung (TW)

( * ) Notice: Subject to any disclaimer, the term of this patent is extended or adjusted under 35 U.S.C. 154(b) by 0 days.

(21) Appl. No.: 15/289,718

(22) Filed: Oct. 10, 2016

(65) Prior Publication Data

US 2018/0099424 A1 Apr. 12, 2018

(51) Int. Cl.

| | |
|---|---|
| ***B26B 5/00*** | (2006.01) |
| ***B26B 29/00*** | (2006.01) |
| ***B26B 29/02*** | (2006.01) |
| *B26B 11/00* | (2006.01) |

(52) U.S. Cl.

CPC ..... *B26B 5/00* (2013.01); *B26B 5/005* (2013.01); *B26B 29/02* (2013.01); *B26B 11/006* (2013.01)

(58) Field of Classification Search

CPC ... B26B 27/005; B26B 21/521; B26B 21/225; B26B 5/005; B26B 5/00; B44D 3/164

USPC .... 30/2, 337, 342, 287, 85, 68, 55, 534, 47; 279/35

See application file for complete search history.

(56) References Cited

U.S. PATENT DOCUMENTS

| | | | | | |
|---|---|---|---|---|---|
| 2,471,334 | A * | 5/1949 | Levin | B26B 5/006 | 30/2 |
| 2,695,450 | A * | 11/1954 | Platts | B26B 3/06 | 30/122 |
| 3,795,979 | A * | 3/1974 | Perry | B26B 21/521 | 30/526 |
| 3,900,950 | A * | 8/1975 | Collins | B23D 51/10 | 30/331 |
| 4,233,737 | A * | 11/1980 | Poehlmann | B26B 1/042 | 30/161 |
| D660,675 | S * | 5/2012 | Gringer | D8/98 | |
| 2010/0263219 | A1* | 10/2010 | Kempker | B25F 1/02 | 30/337 |
| 2010/0293796 | A1* | 11/2010 | Votolato | B26B 29/00 | 30/287 |
| 2014/0173914 | A1* | 6/2014 | Yu Chen | B26B 27/005 | 30/278 |
| 2014/0230258 | A1* | 8/2014 | Eagleton | B26B 21/522 | 30/527 |
| 2014/0345146 | A1* | 11/2014 | Schekalla | B26B 3/00 | 30/169 |
| 2015/0298330 | A1* | 10/2015 | Yu Chen | B26B 27/005 | 30/280 |
| 2015/0328788 | A1* | 11/2015 | Ren | B26B 21/52 | 30/526 |

(Continued)

*Primary Examiner* — Laura M Lee

(57) ABSTRACT

A cutter includes a handle, a blade unit and a lock. The handle includes a slot in an end. The blade unit includes a holder and a blade. The holder includes an insert extending from a sheath. The sheath includes two channels made with small width so that a finger cannot be inserted into any of the channels. The insert is adapted for insertion in the slot. The blade is inserted in the sheath, with two exposed portions exposed to the exterior of the sheath through the channels. The lock is connected to the handle near the slot and movable between a locking position for keeping the insert in the slot and a releasing position for allowing the insert to leave the slot.

10 Claims, 5 Drawing Sheets

(56) References Cited

U.S. PATENT DOCUMENTS

2016/0250760 A1* 9/2016 Phoon ..... B26B 19/386
30/277.4

* cited by examiner

CUTTER

BACKGROUND OF INVENTION

1. Field of Invention

The present invention relates to a cutter and, more particularly, to a cutter for cutting a duct tape.

2. Related Prior Art

A typical retractable cutter includes a handle, a blade, a sliding element and a plug. The handle includes two open ends. The blade is retractable into and extensible from the handle via the first open end. A first portion of the sliding element is inserted in the handle in a sliding manner and connected to the blade. A second portion of the sliding element is located out of the handle. A user pushes the sliding element with his or her thumb to slide the blade relative to the handle. The plug is fitted in the second open end to keep the first portion of the sliding element in the handle and hence keep the blade connected to the handle. However, the user could easily get cut by the blade because of easy access to the blade.

The present invention is therefore intended to obviate or at least alleviate the problems encountered in prior art.

SUMMARY OF INVENTION

It is the objective of the present invention to provide a cutter particularly useful for cutting a duct tape.

To achieve the foregoing objective, the cutter includes a handle, a blade unit and a lock. The handle includes a slot in an end. The blade unit includes a holder and a blade. The holder includes an insert extending from a sheath. The sheath includes two channels made with small width so that a finger cannot be inserted into any of the channels. The insert is adapted for insertion in the slot. The blade is inserted in the sheath, with two exposed portions exposed to the exterior of the sheath through the channels. The lock is connected to the handle near the slot and movable between a locking position for keeping the insert in the slot and a releasing position for allowing the insert to leave the slot.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
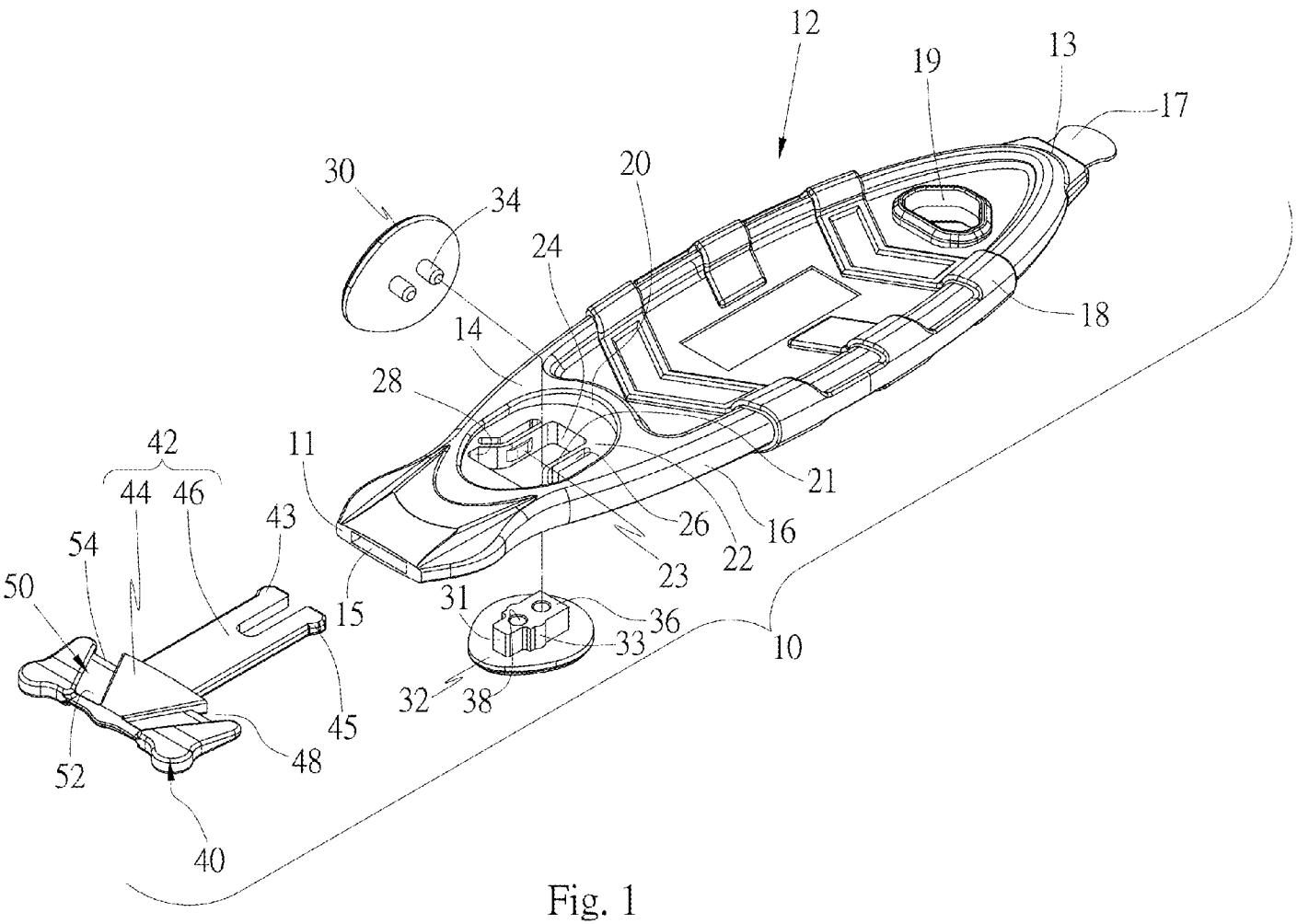
FIG. 1 is an exploded view of a cutter according to the preferred embodiment of the present invention.
Figure 2:
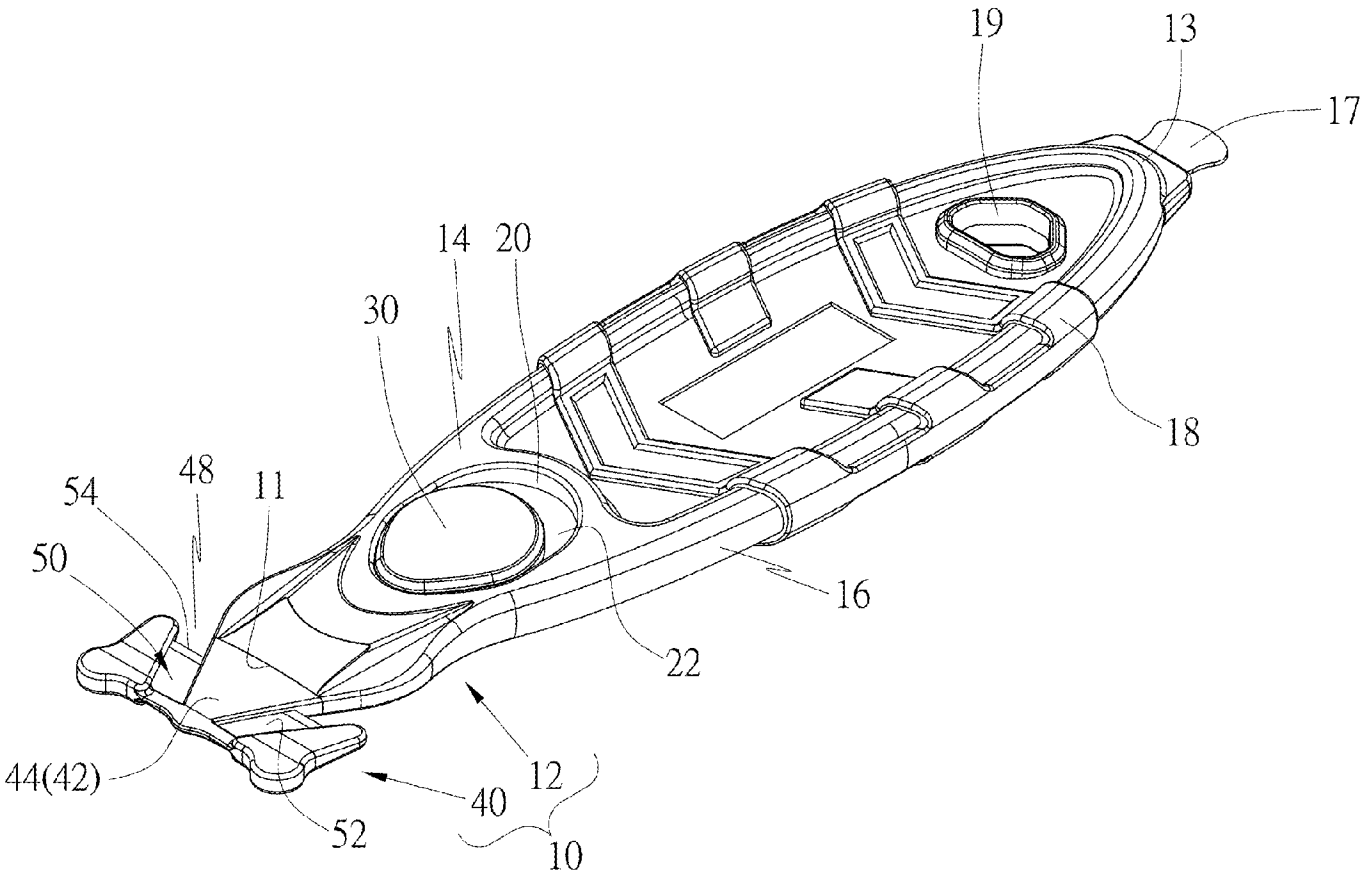
FIG. 2 is a perspective view of the cutter shown in FIG. 1.

Referring to FIGS. 1 and 2, a cutter 10 includes a handle 12, a lock 30 and a blade unit 40 according to the preferred embodiment of the present invention. The handle 12 includes two opposite ends 11 and 13, two opposite faces 14 and two opposite edges 16. The end 11 is a flat end that is connected to the faces 14 and the edges 16. The faces 14 are connected to the edges 16. The edges 16 meet each other at the end 13. The edges 16 are curved for ergonomic purposes to enable a user to comfortably hold the handle 12.

A slot 15 is made in the end 11. A scraper 17 is provided at the end 13. The scraper 17 is used to scrap portions of duct tapes, films or the like. Several ribs 18 are formed on each of the faces 14. The ribs 18 are used to facilitate the grip of the handle 12. An opening 19 extends throughout the faces 14, near the end 13. With the opening 19 receiving a nail or a hook for example, handle 12 is hung on the nail or the hook. A cavity 20 is made in each of the faces 14. The cavities 20 are separated from each other by a partition 22. The partition 22 is a thickness-reduced portion of the handle 12. The partition 22 includes a space 24, two slits 26 and two cutouts 28. The cavities 20 are in communication with each other via the space 24.

Figure 3:
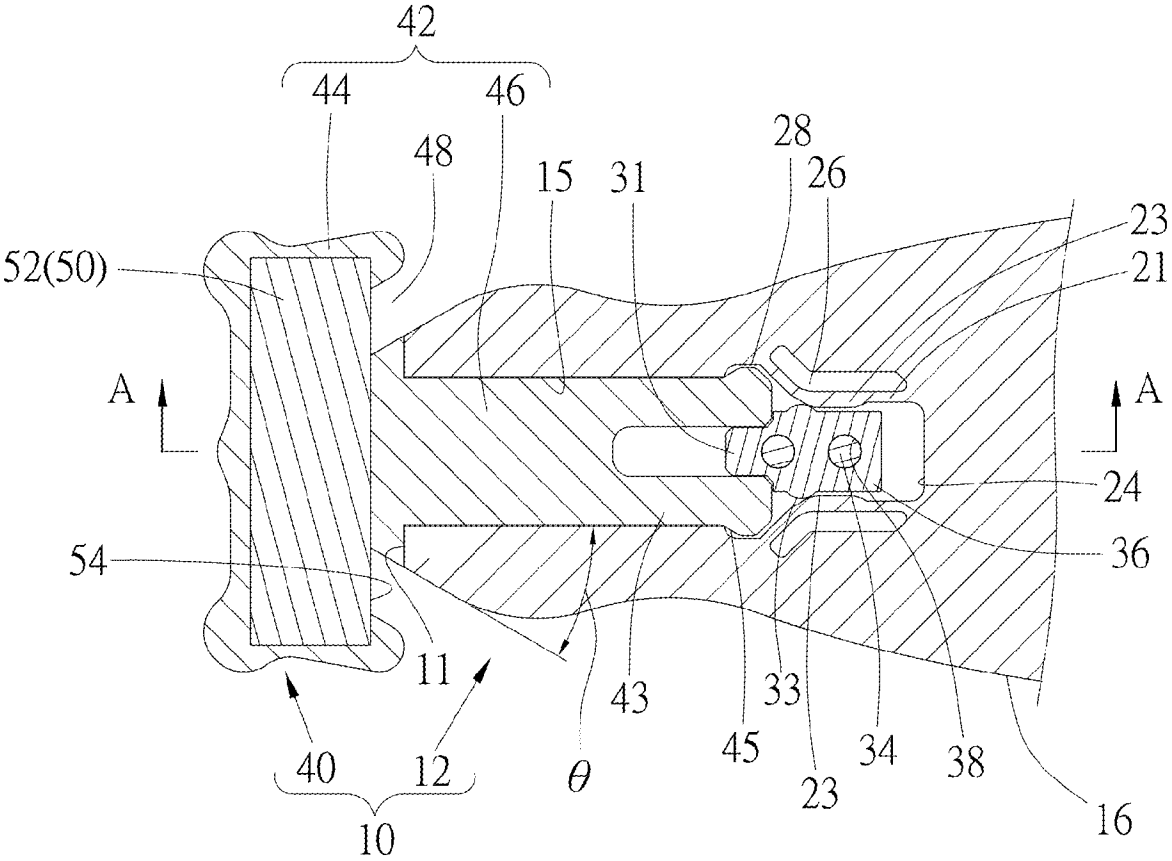
FIG. 3 is a cross-sectional view of the cutter shown in FIG. 2.

Referring to FIG. 3, the space 24 is located at a same distance from each of the edges 16. The space 24 includes a closed end and an open end. Via the open end, the space 24 is in communication with the slot 15. The slits 26 are located on two opposite sides of the space 24. Thus, an elastic strip 21 is formed between the space 24 and each of the slits 26. Each of the elastic strips 21 is formed with a protrusion 23. The protrusions 23 face each other. The cutouts 28 are located on two opposite sides of the space 24. The distance between tips of the protrusions 23 is shorter than the width of the space 24. The distance between the cutouts 28 is longer than the width of the space 24.

Figure 4:
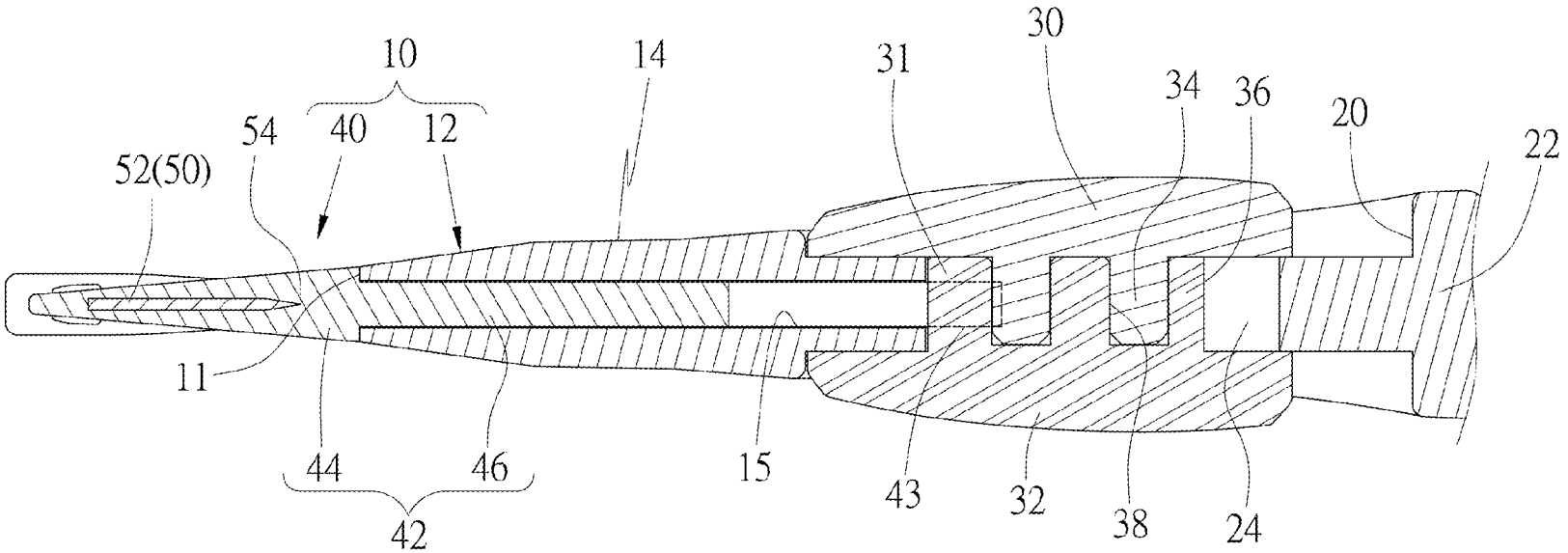
FIG. 4 is a cross-sectional view of the cutter taken along a line A-A shown in FIG. 3.

Referring to FIGS. 1 and 4, the lock includes two sliding elements 30 and 32. The profile of the sliding element 30 is like that of the sliding element 32. The sliding element 30 includes two rods 34 that extend parallel to each other. The sliding element 32 includes two bores 38 for receiving the rods 34, thereby connecting the sliding element 32 to the sliding element 30. The sliding element 32 is formed with a core 36. The core 36 includes a width-reduced portion 31. The core 36 includes two bosses 33 on two opposite sides.

When the sliding elements 30 and 32 are inserted in the cavities 20, the rods 34 are inserted in the bores 38 to connect the sliding element 30 to the sliding element 32. The reduced portion 31 faces the slot 15. The core 36 is inserted in the space 24 of the partition 22, without interfering with sliding of the sliding elements 30 and 32 between a closed position and an open position.

In another embodiment, the handle 12 includes only one cavity 20, and the sliding element 30 is omitted.

Referring to FIGS. 1 and 2, the blade unit 40 includes a holder 42 and a blade 50. The holder 42 is made of a plastic material and includes a sheath 44 and an insert 46. The sheath 44 includes two channels 48. There is an angle θ of 30°±5° between the insert 46 and each of the channels 48. Thickness of the insert 46 is smaller than that of the slot 15 to allow smooth insertion of the insert 46 in the slot 15. The insert 46 includes two anchors 43 opposite to the sheath 44. Preferably, the anchors 43 are separated from each other by a gap (not numbered). Each of the anchors 43 includes a boss 45. The bosses 45 extend away from each other.

The blade 50 includes a cutting edge 54. The blade 50 is held or wrapped by the sheath 44, with two exposed portions 52 exposed to the exterior of the sheath 44 through the channels 48. The width of the channels 48 is small so that the user is not like to insert his or her finger in any of the channels 48 and get cut by the cutting edge 54.

Referring to FIGS. 3 and 4, the distance between tips of the bosses 45 is larger than the width of the insert 46 and the width of the slot 15. Hence, the anchors 43 are biased toward each other to reduce the distance between the tips of the two bosses 45 when the insert 46 is inserted in the slot 15 by force. The anchors 43 return to their original positions because of elasticity when the bosses 45 enter the cutouts 28.

The lock is moveable between a locking position and a releasing position by pressing the sliding elements 30 and 32. The core 36 is located closer to the end 11 in the locking position than in the releasing position.

In the locking position, the reduced portion 31 is inserted in the gap between the anchors 43 to push the bosses 45 away from each other. The distance between the tips of the bosses 45 is equal to or smaller than the distance between the cutouts 28 but larger than the slot 15 so that the insert 46 is kept in the handle 12. That is, the connection of the blade unit 40 to the handle 12 is retained.

The distance between tips of the bosses 33 is smaller than the width of the space 24, but larger than the distance between the protrusions 23. Hence, the protrusions 23 abut against the bosses 33, to prevent translation of the core 36 toward the closed end of the space 24. The core 36 is kept in position when the sliding elements 30 and 32 are released.

Figure 5:
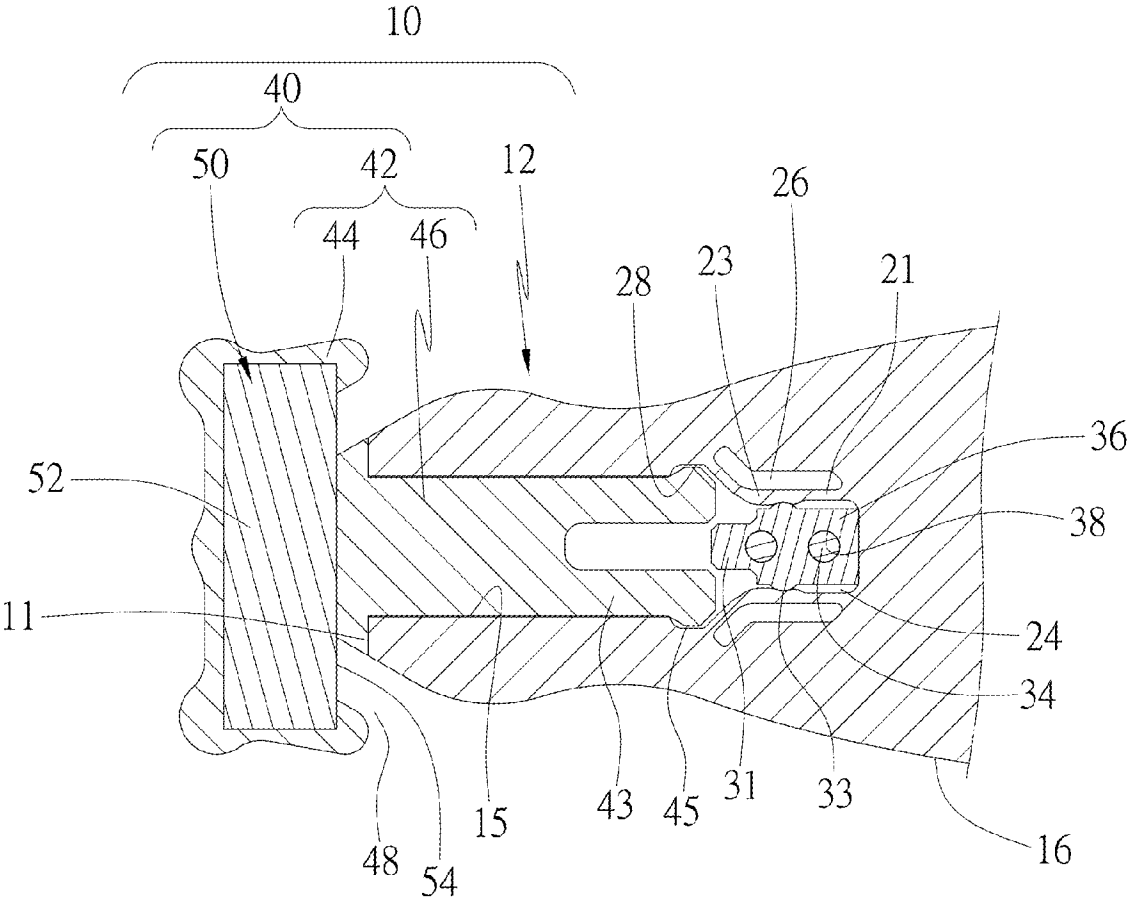
FIG. 5 is a cross-sectional view of the cutter in another position than shown in FIG. 3.

Referring to FIG. 5, in the releasing position, the sliding elements 30 and 32 are operated to move the core 36 toward the closed end of the space 24 by force and hence move the reduced portion 31 out of the gap between the anchors 43. Hence, two anchors 43 are allowed to pivot toward each and move in the slot 15. Accordingly, the blade unit 40 is detached from the handle 12.

The bosses 33 are abutted against the protrusions 23 during the translation to the releasing position from the locking position. The protrusions 23 move the bosses 33 away from the closed end of the space 24 when the sliding elements 30 and 32 are released. Hence, the lock is returned to the locking position.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A cutter comprising:

a handle comprising an end, a slot in the end, a space in communication with the slot, and two cutouts in communication with and on two opposite sides of the space;

a blade unit comprising:

a holder comprising a sheath and an insert extending from the sheath, wherein the sheath comprises two channels, and the insert is adapted for insertion in the slot and comprises two anchors separated from each other by a gap and each formed with a boss adapted for insertion in a corresponding one of the cutouts; and a blade inserted in the sheath and formed with two exposed portions exposed to the exterior of the sheath through the channels; and a lock connected to the handle near the slot and comprising a core movable in the space between a locking position for keeping the insert in the slot and a releasing position for allowing the insert to leave the slot, wherein the core comprises a reduced portion, the reduced portion of the core is inserted in the gap between the anchors to prevent the anchors from approaching each other and hence keep the bosses in the cutouts when the core is in the locking position, and the reduced portion of the core is removed from the gap between the anchors to allow the bosses to pivot toward each other to allow the bosses to move out of the cutouts when the core is in the releasing position.

2. The cutter according to claim 1, wherein the handle comprises two slits on two opposite sides of the space, thereby forming two elastic strips each extending between the space and a corresponding one of the slits, and the elastic strips abut against the core when the core of the lock is in the releasing position, thereby tending to move the core of the lock to the locking position.

3. The cutter according to claim 2, wherein each of the elastic strips comprises a protrusion, and the core comprises two bosses in contact with the protrusions when the core of the lock is in the releasing position.

4. The cutter according to claim 1, wherein the lock comprises at least one sliding element connected to the core and located out of the space so that the sliding element can be operable to move the core in the space.

5. The cutter according to claim 4, wherein the handle comprises at least one cavity for movably receiving the sliding element.

6. The cutter according to claim 4, wherein the lock comprises two sliding elements attached to opposite sides of the core.

7. The cutter according to claim 6, wherein the handle comprises two cavities each for movably receiving a corresponding one of the sliding elements.

8. The cutter according to claim 6, wherein the core and one of the sliding elements are made in one piece.

9. The cutter according to claim 8, wherein the core comprises at least one bore, and the other sliding element comprises at least one rod fitted in the bore.

10. The cutter according to claim 1, wherein each of the channels extends at an angle $\theta$ of $30° \pm 5°$ from the insert.

* * * * *